United States Patent [19]

Putman et al.

[11] 4,330,895

[45] May 25, 1982

[54] STABILIZER FOR REDUCING MOTION OF AN OBJECT DISPOSED IN A FLUID

[75] Inventors: Stephen Putman; Frederick L. Erickson, both of Fort Wayne, Ind.

[73] Assignee: The United States of America as represented by the Secretary of the Navy, Washington, D.C.

[21] Appl. No.: 80,761

[22] Filed: Oct. 1, 1979

[51] Int. Cl.[3] ..... B63B 21/52

[52] U.S. Cl. ..... 441/22; 114/311; 367/4; 367/173

[58] Field of Search ..... 367/4, 173; 244/138 A, 244/138 R, 149; 114/311; 9/8 R

[56] References Cited

U.S. PATENT DOCUMENTS

| | | | |
|---|---|---|---|
| 1,774,811 | 9/1930 | Nelson | 244/149 |
| 2,534,710 | 12/1950 | Golian et al. | 9/8 R |
| 2,737,359 | 3/1956 | Brown | 244/149 |
| 3,613,097 | 10/1971 | Daughenbaugh | 9/8 R X |
| 3,701,175 | 10/1972 | Widenhofer | 9/8 R |
| 3,800,271 | 3/1974 | Stillman, Jr. | 9/8 R X |
| 4,189,703 | 2/1980 | Bennett | 9/8 R X |

*Primary Examiner*—Sherman D. Basinger

*Attorney, Agent, or Firm*—R. S. Sciascia; Henry Hansen

[57] ABSTRACT

A stabilizer or drogue, packageable in a minimal volume, which can be automatically deployed to dampen horizontal, vertical and rotational motion of a device, such as a hydrophone, operating in a relatively viscous fluid. The stabilizer is disposed on a line or cable connected between the device and a surface float, and includes a horizontally oriented fabric fin extended and supported by a plurality of rigid arms, and a plurality of vertically oriented perpendicular fabric fins connected to, extended and supported by the arms and by a rigid vertical tube slidably disposed on the line. The arms are adjacently pivotably connected to a rigid body loaded by the device. Before deployment, the fabric is wrapped around the tube, and the arms are in a raised position substantially adjacent and parallel to the line and the tube, all stowed within a cylindrical container having an open end. The closed end of the container is fixedly connected to the line. The weight of the device acting against the body causes withdrawal of the stabilizer from the open end of the container. Tension on the cable applied by the buoyancy of the float and the weight of the device forces a locking plug, connected to the line, up against the ends of the arms adjacent the line, forcing the arms to pivot 90° away from the line perpendicular with respect to each other to extend the fabric and thereby deploy the stabilizer.

23 Claims, 10 Drawing Figures

FIG. 1
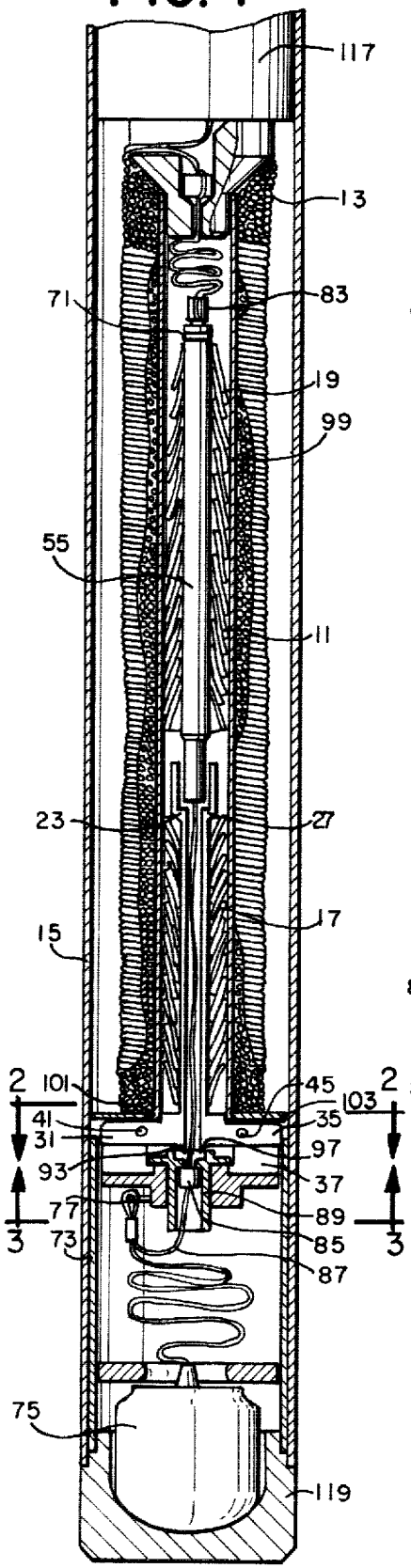
FIG. 5
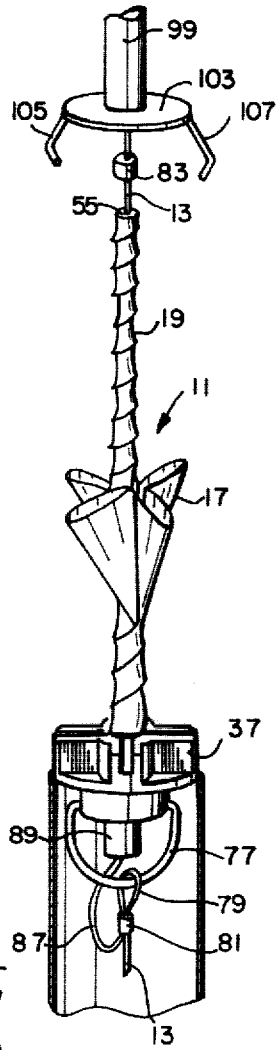
FIG. 6
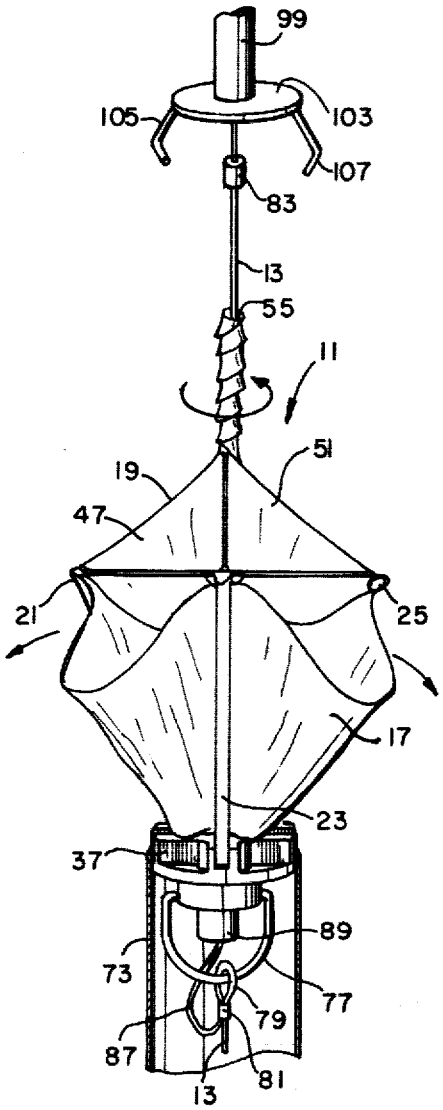
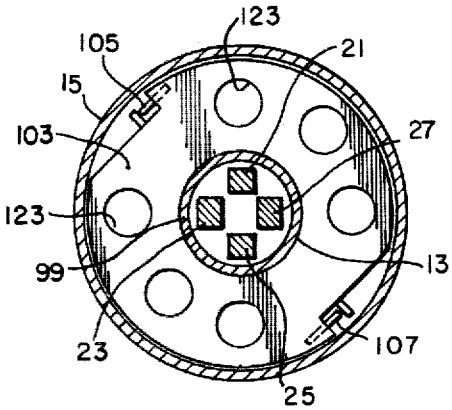
FIG. 2

STABILIZER FOR REDUCING MOTION OF AN OBJECT DISPOSED IN A FLUID

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to devices for stabilizing an object connected thereto, and more particularly to automatically deployable devices capable of reducing movement of an object disposed in a fluid.

It is frequently desired that an aquatic devices floating in water or supported by a water-born float, such as a buoy, be maintained unattended at or near a specific predetermined location. Also, proper operation of such devices frequently requires that they be stabilized and not be readily displaced by wave or current action.

A sonobuoy is a device, capable of being dropped from an aircraft into a body of water, which detects underwater sounds and transmits them to a remote receiver. One example of a sonobuoy includes a hydrophone suspended in the water below a flotation device. Wave action, currents and other movement of the water can induce oscillations, displacement or other movement of such a hydrophone with respect to the Earth, such as by moving the float. Such movement of the hydrophone can cause a reduced signal-to-noise ratio resulting from introduction of the oscillation, and erroneous or varying data resulting from any change in hydrophone position. Mechanical oscillations and thus noise can also be caused by deployment and dropping of the hydrophone from the float, followed by attempting to restrict movement of the hydrophone at a preselected depth. Any device in a sonobuoy should be automatically deployable because of the depth at which such devices are often deployed, and to permit rapid deployment of a large number of sonobuoys over a substantial surface area. Various devices have been used for damping of a sonobuoy hydrophone disposed in water. However, the size limitations of sonobuoy housing within which all sonobuoy components must be stowed for dropping and impact on the water impose constraints in stored size and thus deployed size, automatic deployability and thus effectiveness of damping devices.

SUMMARY OF THE INVENTION

Accordingly, it is a general purpose of the invention to provide a stowable, automatically deployable stabilizer capable of reducing motion of an object disposed in a fluid.

Other objects of the present invention are to provide a stabilizer which is capable of damping vertical, horizontal and rotational motion of a suspended hydrophone or other device disposed in a viscous or other fluid, providing horizontal, vertical and rotational stabilization to such a device, isolating subsurface payloads from vertical and other excursions of a floating device to which it is attached for support, reducing mechanically induced noise, reducing noise caused by surface wave motion, and improving hydrophone signal-to-noise ratio and detection capability.

Further objects of the present invention are to provide a dynamic motion stabilizer which can be proportioned to satisfy various package configurations, does not require supplemental energy sources for deployment, utilizes the inherent line tension for activation, is prevented from collapsing as long as cable tension is maintained, can be deployed and held in its deployed position by utilizing the weight of the device to be stabilized, is capable of being packed in a minimal volume, is capable of being folded and stored within a small protective container until needed and deployed, and has good packing efficiency comparing stored volume with deployed surface area.

Still further objects of the present invention are to provide a water-borne or supported device such as a buoy or sonobuoy which is provided with vertical, horizontal, and rotational stabilization.

Briefly, these and other objects of the present invention are accomplished by a plurality of fins or vanes or plates configured to at least restrict the passage of fluid therethrough and at least some of which are arranged at predetermined angles to certain of the other vanes. The vanes are preferably of flexible material. Certain of these vanes are connected to and supported by a plurality of rigid members or arms extending from and pivotally connected to a rigid body connected to support the hydrophone or other object whose motion is being damped. Certain of these vanes are also or other vanes are connected to and supported by a split rigid tube or arbor slidably disposed on the line or member by which the load is to ultimately be supported. Slidably disposed in the body is a rigid plug fixedly connected to the supporting line or member which can be displaced relative to the body by relative movement of the supporting line or member. Such movement of the line can result from descent or dropping of the load from its ultimately intended support. While the stabilizer is not under load, the vanes can be folded, the rigid members can be pivoted to be parallel to the supporting line instead of extending from it, and so the stabilizer can be collapsed about the load supporting line or member in a small volume for storage in a fixed container. When the stabilizer experiences tension loading exerted by the ultimate load support and the weight of the load, the plug is moved by the line to force the rigid members to pivot away from the line and extend the vanes. Maintenance by the tube and rigid members of the plurality of vanes at various relative orientations dampens or restricts oscillation or other movement of the load in the various directions perpendicular to those vanes. At least one vane is disposed simultaneously parallel to and perpendicularly extending from the supporting line to dampen any rotational motion of the load about the axis of the line. While line tension load is applied to the stabilizer, the plug prevents the vanes and the rigid members from closing.

Other objects, advantages and novel features of the invention will become apparent from the following detailed description of the invention when considered in conjunction with the accompanying drawings wherein:

BRIEF DESCRIPTION OF THE DRAWINGS

FIG. 1 shows a longitudinal section of a preferred embodiment of a sonobuoy according to the present invention containing a preferred embodiment of a stabilizer according to the present invention in one stage of operation collapsed and stowed therein;

FIG. 2 shows a section of the sonobuoy taken on the line 2—2 of FIG. 1;

FIG. 5 shows a subsequent stage of deployment of the stabilizer of FIG. 1 during deployment of the sonobuoy of FIG. 1;

FIG. 6 shows a still subsequent stage in the deployment of the stabilizer of FIG. 1;

DESCRIPTION OF THE PREFERRED EMBODIMENT

Figure 7:
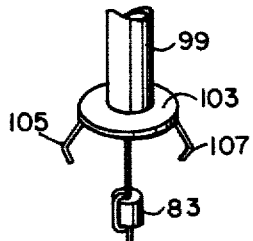
FIG. 7 is a side elevation of the sonobuoy of FIG. 1 when fully deployed.
Figure 7:
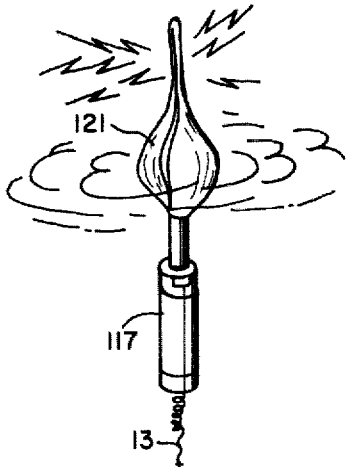
Figure 7:
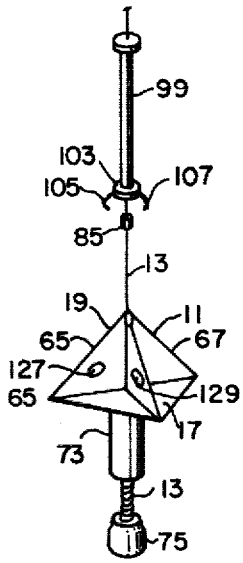
Figure 8:
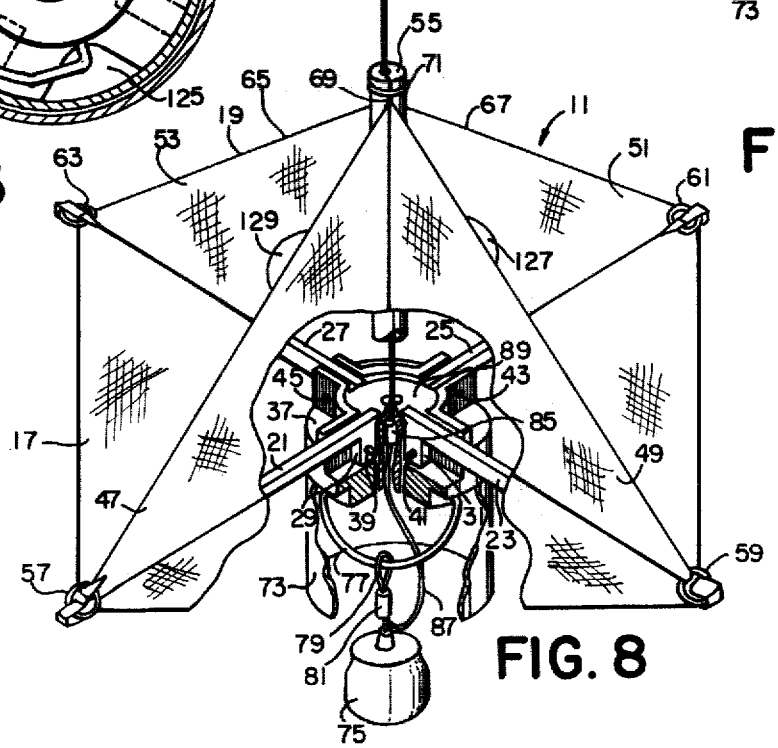
FIG. 8 shows the fully deployed stabilizer of FIG. 7 in greater detail in a side elevation with a portion shown in a sectional view.
Figure 9:
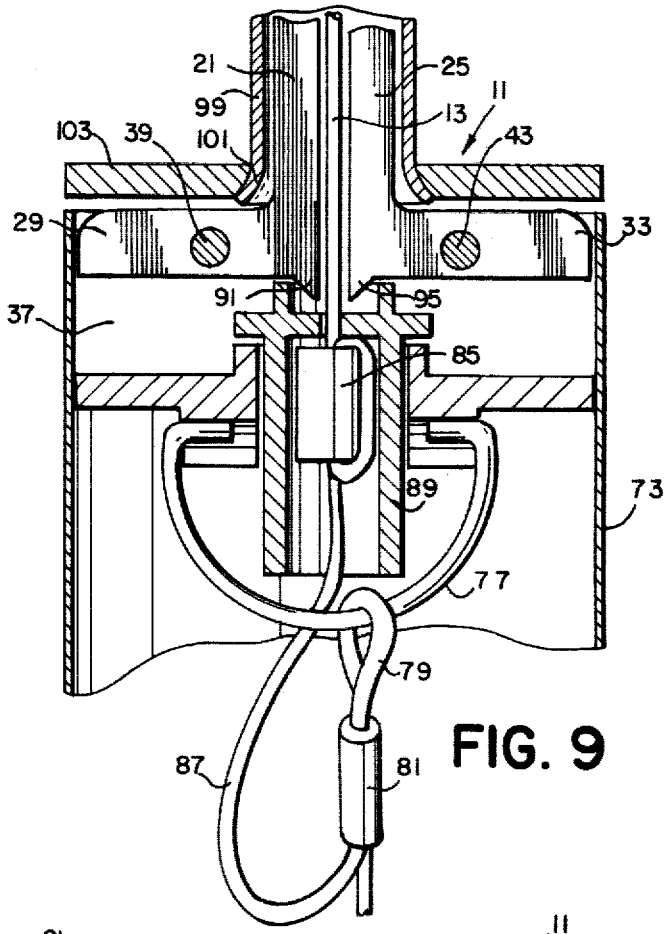
FIG. 9 is an enlarged view of a portion of the stabilizer of FIG. 1.
Figure 10:
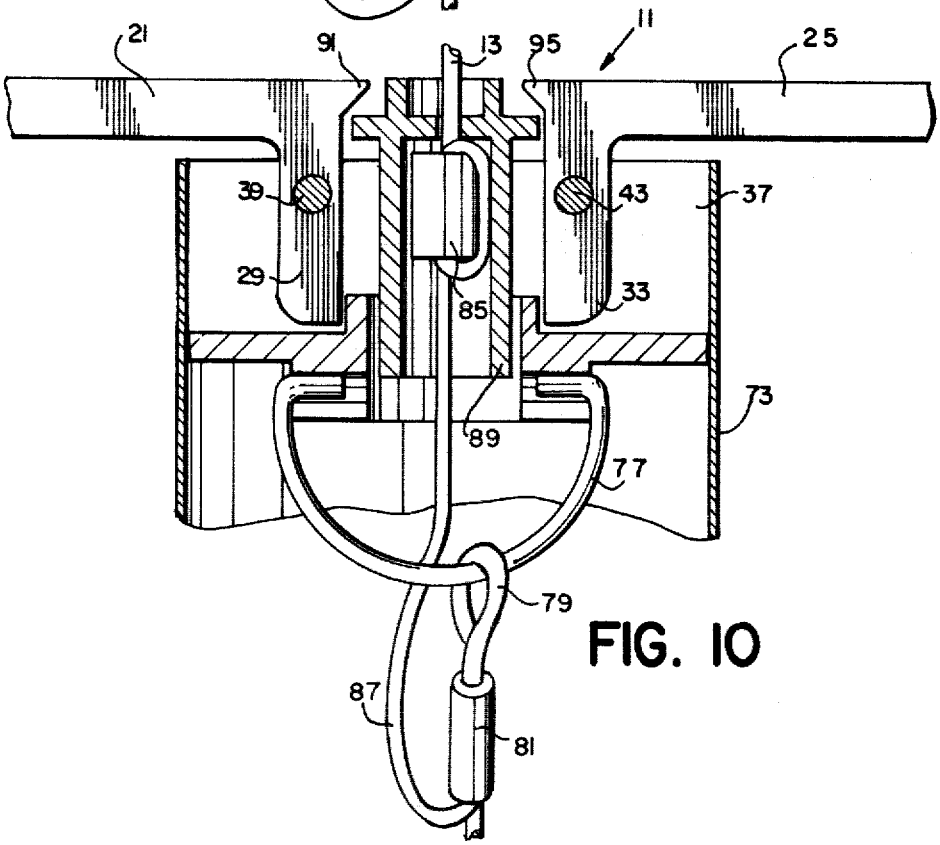
FIG. 10 is an enlarged view of a like portion of the stabilizer of FIG. 8.

Referring now to the drawings, wherein like reference characters designate like or corresponding parts throughout the several views, there is shown in FIGS. 1-10 a stowable, deployable stabilizer or sea anchor I1 disposed on a line 13 and stowable within a sonobuoy casing 15. Stabilizer 11 includes a vertical stabilizer 17 and a horizontal stabilizer 19. Vertical stabilizer 17 is supported by four preferably rigid arms 21, 23, 25 and 27 pivotably connected on perpendicular extensions thereof, respectively 29, 31, 33 and 35, to a stabilizer body 37 by respective hinge pins 39, 41, 43 and 44. "Vertical" and "horizontal" as applied to stabilizers portions 17 and 19 refers to the respective motions damped thereby, as to be differentiated from the respective orientations of these stabilizer portions such as with respect to the supporting line 13. Horizontal stabilizer portion 19 can for example include four right triangular flexible vanes or fins 47, 49, 51 and 53 each connected to and supported along one edge by arbor or cylindrical tube 55 slidably disposed along its longitudinal axis on supporting line or cable 13. Each fin 47, 49, 51 and 53 is at a respective corner distant from arbor 55 and line 13 connected to and supported by one end, distant from stabilizer body 37, of a respective arm 21, 23, 25 or 27 by respective nylon thread portions 57, 59, 61 and 63. Each thread loop 57, 59, 61 and 63 can for example be connected between the fold of a respective folded-over distant corner of respective fin 47, 49, 51 or 53 and a hole in the distant end of respective arm 21, 23, 25 or 27 through which the respective thread is looped. Horizontal stabilizer portion 19 can for example include two isosceles triangular panels or portions 65 and 67, each panel including two adjacent fins and passing at its vertical axis through vertical slot 69 in arbor 55. This use of two panels 65 and 67 minimizes bunching in the middle of stabilizer 11 about arbor 55 when stabilizer 11 is wound down for stowage in mandrel 99, to minimize storage volume of stabilizer 11. O-ring disposed about a circumference of arbor 55 near one end thereof holds arbor 55 closed and prevents arbor 55 from being split open at slit 69. Stabilizer body 37 is fixedly connected to a cylindrical canister 73 in which hydrophone or other device 75 to be dampened is disposed while stowed in sonobuoy casing 15. Hydrophone 75 is connected to and supported by stabilizer body 37 via bale or hanger bar 77 pivotably connected to stabilizer body 37, and via loop 79 formed in line 13 by metal fastener 81. The position of stabilizer 11 on line 13 is regulated by two rubber or plastic stoppers or glands 83 and 85 respectively tied onto line 13 above and below the intended position of stabilizer 11. Line 13 is looped through glands 83 and 85, which serve as stops for stabilizer 11 disposed therebetween. Locking plug 89 is slidably disposed on line 13 between body 37 and gland 85 and is configured to engage arms 21, 23, 25 and 27 which are each provided with a respective tab or projection 91, 93, 95 or 97 in the form of a rounded 45° isosceles right triangle to extend the duration of maintained engagement between locking plug 89 and these near ends of the arms, as can be seen in FIGS. 9 and 10. Hydrophone 75 is connected to line 13 by loop 79 therein and fastener 81, but is partially isolated from movement of line 13 by a bight or bend 87 formed in line 13 between lower gland 85 and fastener 81, as well as by its connection to body 37 by bale 77.

As is shown in FIG. 1, stabilizer 11 when stowed in sonobuoy casing 15 is disposed within wire-carrying spool or mandrel 99, with body 37 and arm perpendicular extensions 29, 31, 33 and 35 abutting the lower end of the mandrel. The lower end of mandrel 99 is provided with a flare 101 for easier insertion and withdrawal of stabilizer portions 17 and 19 and to support and retain a flange 103 to which two retaining hooks or retainers 105 and 107 are pivotably attached. Retainers or keeper pins 105 and 107, which can for example be of metal with plastic sleeving for less friction, are configured to enter respective retainer clearance slots 109 and 111 in canister or housing 73 and releasably engage respective retainer clearance grooves 113 and 115 in body 37, and are held in place therein by sonobuoy housing or casing 15 to prevent premature separation of stabilizer 11 and mandrel 99. One segment of line 13 extends from electronics and battery pack 117 disposed in the upper part of sonobuoy housing or casing 15, is wound around mandrel 99 to approximately 1,000 feet of line, is fastened to the upper end of mandrel 99 opposite flange 103 and stabilizer body 37, and then another segment passes with some slack through the interior of mandrel 99 to pass through body 37 to hydrophone 75. A weight 119 is attached to the lower end of sonobuoy casing 15 near hydrophone 75 to aid descent through the water.

As is shown in FIG. 1, while stowed in mandrel 99, stabilizer 11 is collapsed. When disposed in mandrel 99, stabilizer 11 is collapsed, arms 21, 23, 25 and 27 are pivoted to be adjacent and parallel to line 13, arbor 55 is drawn up to the extent permitted by upper gland 83, which prevents damage to stabilizer 11 while stowed, and fins 47, 49, 51 and 53 and vertical stabilizer 17 are folded and wound about line 13. The distal ends of arms 21, 23, 25 and 27 and the lower end of arbor 55 can be configured so that one engages the other for more secure stowage, for reduction of possible damage to the stabilizer, and to conserve space. The various fins 47, 49, 51 and 53 and vertical stabilizer 17 are wound separately about arbor 55, or folded arms 21, 23, 25 and 27, respectively.

Figure 4:
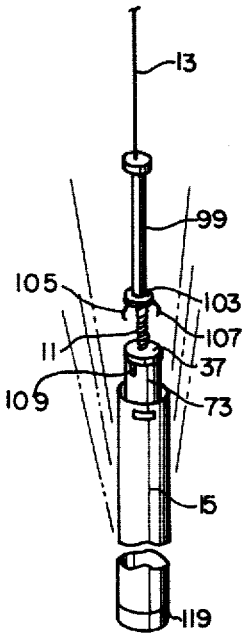
FIG. 4 shows an early stage of deployment of the stabilizer of FIG. 1 during deployment in water of the sonobuoy of FIG. 1.
Figure 3:
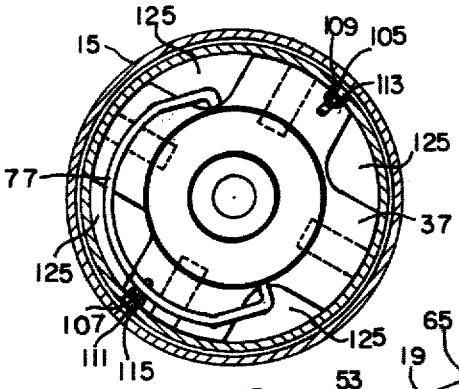
FIG. 3 shows a section of the sonobuoy taken on the line 3—3 of FIG. 1.

Deployment and locking of stabilizer 11 can be accomplished utilizing the weight of the device 25 whose motion is to be damped. After the sonobuoy housing 15 is launched or dropped and enters the water, the weight 119 on the lower end of the housing causes the housing to descend in the water, taking with it stabilizer 11, mandrel 99 and hydrophone 75. Meanwhile, water contact can trigger inflation of float 121. Float 121 can be inflated with pressurized carbon dioxide or other gas. As housing 15 sinks, a portion of line 13 pays off of mandrel 99 since the upper end of the line is fastened to electronics pack 117 which is supported by float 121. The length of the portion of line 13 wound about mandrel 99 can maintain the intended operating depth of hydrophone 75, and can for example be 1000 feet long. The end of this wound length of line 13 is attached to the upper end of mandrel 99 nearest pack 117. Accordingly, when all of the wound portion of line 13 have been wound off of mandrel 99, housing 15 will continue to sink in the water and will fall away from mandrel 99 and housing 73 which are supported by line 13. When payout of line 13 from mandrel 99 is complete and casing 15 should separate from mandrel 99 and housing 73, if air is present between stabilizer body 37 and casing 15, then a pressure differential between the water outside the casing and the air within the casing may be present which can restrict relative movement of body 37 and casing 15. Accordingly, flange 103 can be provided with a plurality of holes 123 which are uncovered by payout of line 13 from mandrel 99, and body 37 can be provided with a plurality of holes 125 between arms 21, 23, 25 and 27, so that water can replace air in the space between body 37 and casing 15 for an easier separation thereof. Mandrel 99 is now fastened to line 13 and housing 73 is connected to mandrel 99 by retainers 105 and 107. Retainers or dips 105 and 107 are each pivotably connected, for example at an angle of 90°, to flange 103 with freedom of movement only in the vertical plane they preferably share with the longitudinal axis of mandrel 99. Each retainer 105 and 107 is preferably provided with a 45° bend towards its end distant from flange 103. While flange 103 is disposed within casing 15, casing 15 abuts and maintains retainers 105 and 107 in respective slots 109 and 111 and respective grooves 113 and 115 to maintain a connection between mandrel 99 and body 37. Thus, once casing 15 slides away from retainers 105 and 107, the weight of thus-freed hydrophone 75 causes body 37, housing 73 and hydrophone 75 to fall away from flange 103, and the 45° rather than for example 90° bend in the retainers permits respective grooves 113 and 115 to exert a cam force on the respective retainers initially disposed therein and urge them away from body 37 and housing 73, so that the body and housing can then fall away from mandrel 99. For easier release, retainers 105 and 107 can each be encased in a plastic sleeve or sleeve of solid lubricant. Accordingly, when housing 15 falls away, retainers 105 and 107 are permitted to release housing 73, so that the weight of hydrophone 75 pulls housing 73 away from mandrel 99, thereby also pulling stowed stabilizer 11 out of mandrel 99, as is shown in FIG. 4.

FIGS. 5 and 6 show stabilizer 19 being unwrapped from arbor 55. Due to the attachment provided by threads 57, 59, 61 and 63 between the four distal tips of horizontal stabilizer 19, and the respective distal tips of the four stabilizer arms 21, 23, 25 and 27, as the arms deploy, deploying vertical stabilizer 17, horizontal stabilizer 19 is simultaneously deployed. The tension load applied to collapsed stabilizer 11 by float 121 and the weight of hydrophone 75 via line 13 and bale 77 causes stabilizer 11 to be unwrapped from line 13 and arbor 55 as shown in FIGS. 5 and 6 to be fully deployed in the configuration shown in FIGS. 7, 8 and 10. Comparing FIGS. 9 and 10, it can be seen that this unwinding of stabilizer 11 results when the tension loading applied to line 13 and stabilizer 11 by float 121 and hydrophone 75 causes part of bight 87 to be taken up, and lower gland 85 to be moved upwards towards float 121 to engage and urge locking plug 89 upwards therewith. This movement of locking plug 89 with respect to body 37 causes it to urged against the ends of arms 21, 23, 25 and 27 near body 37, urging the arms to pivot away from line 13 about their respective hinge pins 39, 41, 43 and 45 to extend and deploy stabilizer 11. Because of the off-center connection of hinge pins 39, 41, 43 and 45 to respective arms 21, 23, 25 and 27, specifically to respective perpendicular extensions 29, 31, 33 and 35, upward movement of locking plug 89 against the folded arms forces them to pivot and fall away from line 13 by 90° to be perpendicular to line 13 when stabilizer 11 is fully deployed. Additionally, gravity aids pivoting and dropping of arms 21, 23, 25 and 27, besides the force exerted by locking plug 89. Horizontal stabilizer 19 then descends on line 13 with arbor 55 until the horizontal stabilizer contacts vertical stabilizer 17. Tab projections 91, 93, 95 and 97, and the shape of the surface of locking plug 89 engaging these projections, permit locking plug 89 to continue to engage arms 21, 23, 25 and 27 to continue to urge them away from line 13 at least until the arms form a substantial angle (such as 45°) with line 13, when gravity and the weight of the column of water above stabilizer 11 can complete deployment of stabilizer 11. After a rotation of 90° has been achieved, the tip of each stabilizer arm 21, 23, 25 and 27 contacts the stabilizer body 37. Body 37 thus prevents further rotation of arms 21, 23, 25 and 27 about hinge pins 39, 41, 43 and 45, respectively. Once arms 21, 23, 25 and 27 have been deployed to be perpendicular to line 13 as shown in FIG. 10 so that stabilizer 11 is fully deployed as shown in FIGS. 7 and 8, locking plug 89 thereafter continues upward an additional distance above hinge pins 39, 41, 43 and 45 to a level at or near that of the fully deployed arms and of horizontal stabilizer portion 19 until stopped by projections 91, 93, 95 and 97, to engage and lock the deployed arms in place. Locking plug 89 maintains the arms in their deployed positions so long as tension loading is applied to stabilizer 11 such as can be applied by float 121 and hydrophone 75.

Housing 15 can for example be of metal in the form of a cylinder 36 inches long by 2¼ inches diameter. Line 13 can for example be of rubber, wire, cable, plastic or nylon rope, can be elastic or compliant, and can be used for electrical communications between hydrophone 75 and pack 117 as well as for support. For example, line 13 can include fifty feet of compliant line with electrical wire coiled thereabout, connected to 950 feet of electrical wire. The portion of line 13 connecting bale 77 and hydrophone 75 can for example be covered with heavy mesh nylon of one inch diameter to protect the line from erosion from movement of water. Stabilizer portions 17 and 19 can for example be of light weight fabric material cut to a predetermined size. Arms 21, 23, 25 and 27 can be glued to vertical stabilizer 17. Stabilizer portions 17 and 19 can for example be constructed of a non-blocked fabric such as fine-grain nylon allowing a portion of any pressure applied thereto to be relieved by passage therethrough to relieve extreme pressure. Each arm 21, 23, 25 and 27 can for example each be of metal and 5 inches long including respective projection 91, 93, 95 and 97. Mandrel 99 can for example be of metal and 12½ inches long. Arbor 55 can for example be of plastic and 5 and ¾ inches long. Each panel 65 or 67 can for example be in the form of an isosceles triangle of sides 10½ inches, 8 inches, and 8 inches long, respectively.

Vertical stabilizer portion 17 can for example be in the form of a square 7½ inches long on any one side. Loops 57, 59, 61 and 63 can for example be of nylon thread. Canister 73 can for example be a seamless aluminum tube. Hydrophone 75 can for example weigh 12 ounces. Weight 119 can for example of brass.

Two adjacent fins of horizontal stabilizer portion 19 can be provided with holes 127 and 129, respectively, which can for example be of 1 inch diameter each, if desired to further restrict rotation of stabilizer 11 and hydrophone 75. If before or during deployment twists appear in line 13, hydrophone 75 could tend to rotate as the cable untwists. This result can be avoided by providing two adjacent fins, such as fin 47 and fin 49, each with one or more perforations orholes. For example, each adjacent fin can be provided with a hole of 1 inch diameter located at the centroid of the triangular fin. The fins provided with holes provide less drag and experience less pressure than do the opposite solid vanes. This imbalance or pressure differential between fins causes a weathervane effect, wherein the solid, higher-pressure fins are pressed back against any direction of rotation, for example to the rear of any flow against stabilizer 11. Stabilizer 11 is thereby held in a relatively fixed orientation, so that float 121 turns with any untwisting of line 13 and hydrophone 75 should not experience any rotation therefrom. A similar effect can be achieved by utilizing two adjacent horizontal stabilizer portion 19 fins which are each smaller than either of the other two fins.

Further information concerning a sonobuoy configuration and deployment can be found in U.S. Patent Application Ser. No. 33,651 filed Apr. 26, 1979 by Stephen G. Putman for "Payload Release Mechanism" which is incorporated by reference herein.

Operation of the foregoing embodiment of the present invention can be summarized as follows. Initially, before deployment, stabilizer 11 is stowed collapsed in sonobuoy casing 15 with stabilizer portions 17 and 19 placed within mandrel 99 and wrapped about arms 21, 23, 25 and 27 collapsed onto line 13, or about arbor 55, respectively. During sonobuoy deployment, float 121 inflates to retain pack 117 near the surface while casing 15 sinks in the water. Line 13 is then unwrapped from mandrel 99 by the tension imposed thereon by float 121 and weight 119. Weight 119 and casing 15, mandrel 99, body 37, housing 73 and hydrophone 75 therewith, descend freely in the water during payout of line 13 from mandrel 99. Payout of line 13 from mandrel 99 continues until hydrophone 75 approaches its operating depth, when payout of line 13 is completed. Since the end of line 13 payout distant from pack 117 is fixedly connected to the top of mandrel 99, the tension loading applied by weight 119 and float 121, and the presence of retainers 105 and 107 releasably connecting mandrel 99 to body 37 and canister 73, causes housing 15 under the influence of weight 119 to fall away from mandrel 99 body 37, canister 73 and hydrophone 75, which are supported by float 121. The weight of hydrophone 75 then causes retainers 105 and 107 to cam away from body 37 and canister 73. The resulting separation between mandrel 99 and body 37 under tension loading from float 121 and the weight of hydrophone 75 causes stabilizer 11 to be extracted from the interior of mandrel 99. Following this extraction, the tension loading imposed by float 121 and hydrophone 75 causes plug 89 to move in body 37 to urge arms 21, 23, 25 and 27 to pivot away from line 13, thus unwrapping stabilizer 11 from about arbor 55 and line 13. When arms 21, 23, 25 and 27 are held perpendicular to each other and to line 13, and stabilizer 11 is fully deployed, the tension loading applied to stabilizer 11 causes locking plug 89 to lock the arms in place on body 37. Once deployed, the presence and orientation of stabilizer portions 17 and 18 restrict vertical, horizontal and rotational motion of hydrophone 75.

It should be understood that other dimensions and materials than those disclosed above can be utilized in the present invention. For example, stabilizer portions 17 and 19 can alternatively be fabricated of thin black polyurethane film formed into vertical and horizontal fins. Stabilizer 11 can be utilized wih or without holes 127 and 129 in adjacent vanes. Horizontal stabilizer 19 can include other numbers of fins or panels or sheets or other planar members. Any number of arms can be utilized, although it is preferred that the number of arms be equal to the number of fins in horizontal stabilizer 19, to better tighten and straighten them while deployed. Vertical stabilizer 17 and horizontal stabilizer 19 can be utilized alone and deployed independently.

Some of the advantages of the present invention should now be readily apparent. For example, a novel automatically deployable stabilizer or sea anchor has been disclosed which is capable of restricting any movement of an object disposed in a fluid. For example, the present stabilizer is capable of isolating a hydrophone deployed in water from any vertical, horizontal and rotational motions of a surface float supporting the hydrophone. Also, the stabilizer is capable of minimizing mechanically induced noise by effectively increasing the water-loading in both the horizontal and vertical planes. Resistance to vertical movement of the deployed hydrophone is further accomplished by the presence of a substantial column of water above the vertical stabilizer portion 17. The stabilizer is capable of good packing efficiency; for example, a deployed horizontal stabilizer portion of 34 square inches and vertical stabilizer portion of 64 square inches can be folded into a storage container of 4.9 cubic inches. The stabilizer can be proportioned to satisfy any desired package or deployed configuration. The stabilizer does not require supplemental energy sources for deployment, but utilizes the inherent cable tension for activation, although gravity and any natural tendency of the wrapped stabilizer portions 17 and 19 to unwrap can assist deployment. The stabilizer incorporates a self-locking or latching feature which prevents it from collapsing as long as line tension is maintained. For a horizontal stabilizer 19 including a plurality of multifin panels such as 65 and 67, and for an arbor 55 slit to accomodate them, the panels can move through the arbor slit or slits for self-centering and for self-alignment with respect to each other and with respect to the stabilizer arms. The stabilizer arms 21, 23, 25 and 27 hold the panels or sheets 17, 47, 49, 51, 53 of the stabilizer tightly and rigidly, to prevent movement of hydrophone or other dampened object 75 due to slack in the planar members. For this purpose, it is preferred that the number of arms equal the number of fins in horizontal stabilizer 19, to better tighten those fins. Horizontal stabilizer 19 allows hydrophone 75 to move with and at the same rate as any current flow about it, so that the hydrophone has no relative flow with respect to the fluid in which it is disposed, thereby minimizing or reducing any noise that might be caused by such current flow.

Obviously, many modifications and variations of the present invention are possible in light of the above teachings. It is therefore to be understood that, within the scope of the appended claims, the invention may be practiced otherwise than as specifically described.

What is claimed is:

1. Apparatus for dampening movement of an object connected thereto, comprising:

a line;

first and second pulling means attached to opposite ends of said line for exerting tension loading thereon;

a first tube connected to said line between said first and second pulling means;

a first sheet member of flexible material;

a plurality of support members connected to said first sheet member and to the object and pivotably connected to said first tube; and first means slidably disposed within said first tube, connected to said line between said first tube and said first pulling means, and configured to engage said support members for pivoting said support members with respect to said first tube while said first tube and said first means are urged in opposite directions by said first and second pulling means.

2. Apparatus as recited in claim 1, further comprising a container connected to said line between one of said pulling means and said first means and configured to slidably contain said first sheet member and said support members while said support members are pivoted in towards said line.

3. Apparatus as recited in claim 1, further comprising a plurality of sheet members of flexible material each connected to said first sheet member and to one of said support members, and disposed at an angle to said first sheet member.

4. Apparatus as recited in claim 3, further comprising a second tube slidably disposed on said line and connected to said plurality of sheet members for supporting said plurality of sheet members.

5. Apparatus as recited in claim 3 further comprising a container connected to said line between one of said pulling means and said first means and configured to slidably contain said first sheet member, said plurality of sheet members and said support members while said support members are pivoted in towards said line.

6. Apparatus for dampening motion of an object disposed in a fluid, comprising:

a first sheet member of flexible material;

a plurality of support members connected to said first sheet member;

pivoting means formed to be connected to the object, responsive to tension loading and pivotably connected to said support members for deploying said first sheet member from a collapsed position to an extended position in response to the tension loading having a first tube pivotably connected to said support members and adapted to receive loading in one direction and having first means slidably disposed within said first tube adapted to receive loading in the opposite direction, and configured to engage said support members for pivoting said support members with respect to said first tube while said first tube and said first means receive respectively appropriately directed loading;

a container configured to slidably contain said plurality of support members and said first sheet member while said first sheet member is collapsed; and retaining means for releasably connecting said container and said first tube.

7. Apparatus as recited in claim 6 wherein said retaining means comprises a plurality of grooves and corresponding pivotal retaining members slidably disposed in said grooves.

8. Apparatus as recited in claim 7 wherein each of said retaining members is provided with a bend forming an angle in said retaining member greater than 90°.

9. Apparatus for dampening motion of an object disposed in a fluid, comprising:

a first sheet member of flexible material;

a plurality of support members connected to said first sheet member;

pivoting means formed to be connected to the object, responsive to tension loading and pivotably connected to said support members for deploying said first sheet member from a collapsed position to an extended position in response to the tension loading;

a plurality of flexible sheet members connected to said first sheet member, each connected to at least one of said plurality of support members, and variously disposed while deployed in planes intersecting both the plane of and a perpendicular of said first sheet member while deployed, having a plurality of flexible material portions each part of two of said sheet members; and a tube connected to said plurality of flexible sheet members for supporting said plurality of flexible sheet members, having a slit through which said portions pass for automatic alignment.

10. Hydrophone suspension system for automatic deployment in water, comprising:

a casing weighted at one end;

a float deployable to the surface of the water from other end of said casing upon immersion;

a hollow mandrel coaxially positioned in said casing adjacent to said float and slidably disposable from said other end of said casing;

a first segment of a line wound around said mandrel for payout of said mandrel below said float, and connected at its ends between said float and one end of said mandrel;

a hydrophone positioned in said casing at said one end thereof, and deployable from said other end thereof;

a second segment of said line stored within said mandrel connected between said one end of said mandrel and said hydrophone; and damper means stored in a collapsed mode within said mandrel, and operatively connected to said second segment intermediate of the ends thereof for deployment from the lower end of said mandrel into a spreading mode in response to the suspension force applied to said second segment by said hydrophone.

11. Hydrophone suspension system as recited in claim 10, wherein said damper means comprises:

pivoting means attached to said mandrel about said second segment and releasable from said mandrel when deployed from said casing;

a plurality of support arms each pivotally connected to said pivoting means and collapsibly stowed in longitudinal position in said mandrel, and deployable to radial positions after said pivoting means is released from said mandrel;

a flexible member attached between said support arms furled within said mandrel and deployable to a planar configuration when said arms are radially positioned; and pivot lock means connected intermediate the ends of said second segment slidably disposed within said pivoting means for urging said arms to the radial position in response to the suspension force.

12. Hydrophone suspension system as recited in claim 11 wherein each of said support arms comprises a perpendicular portion thereof proximal within said pivoting means and at which said support arms are pivotably connected to said pivoting means.

13. Hydrophone suspension system as recited in claim 12 wherein each of said support arms comprises a longitudinal portion thereof proximal within said pivoting means and configured to engage said pivot lock means during a substantial portion of the pivoting of said support arms caused by said pivot lock means.

14. Hydrophone suspension system as recited in claim 11, wherein said damper means further comprising:

an arbor coaxially positioned within said mandrel and slidably disposed along its longitudinal axis on the second segment;

a plurality of vanes stored in a collapsed mode within said mandrel each connected between said arbor and respective ones of said arms.

15. Apparatus as recited in claim 14 wherein at least one of said plurality of vanes is provided with less surface area than others of said plurality of vanes for restricting the rotation of the object.

16. Apparatus as recited in claim 15 wherein said one vane is provided with a hole for restricting the rotation of the object.

17. Hydrophone suspension system as recited in claim 14 wherein said arbor is connected to said plurality of vanes for supporting said plurality of vanes.

18. Hydrophone suspension system as recited in claim 17 wherein:

said plurality of vanes comprises a plurality of portions of flexible material, each portion comprising two of said plurality of vanes; and said arbor is provided with a slit through which said portions pass for automatic alignment.

19. Hydrophone suspension system as recited in claim 10, further comprising retaining means for releasably connecting said mandrel and said damper means.

20. Hydrophone suspension system as recited in claim 19 wherein said retaining means comprises a plurality of grooves and corresponding pivotal retaining members slidably disposed in said grooves.

21. Hydrophone suspension system as recited in claim 20 wherein each of said retaining members is provided with a bend forming an angle in said retaining member greater than 90°.

22. Deployable apparatus for dampening motion of an object suspended in a fluid from a remote platform comprising:

a first segment of a line formed to be connected at the upper end to the platform;

a container attached at the upper end thereof to the lower end of said first segment;

a second segment of said line stored in said container connected at the upper end to said container and formed to be connected at the lower end to the object; and damper means stored in a collapsed mode, and in said container operatively connected to said second segment intermediate of the ends thereof for deployment from the lower end of said container into a spreading mode in response to the suspension force applied to said second segment by the object, and including pivoting means positioned about said second segment for providing a foundation for said damper means, a plurality of support arms each pivotally connected to said pivoting means and collapsibly stowed in longitudinal position in said container, and deployable to radial positions after said damper means is deployed from said container, a flexible member attached between said support arms furled within said container and deployable to a planar configuration when said arms are radially positioned, and pivot lock means connected intermediate the ends of said second line slidably disposed within said pivoting means for urging said arms to the radial position in response to the suspension force.

23. Deployable apparatus as recited in claim 22 wherein said damper means further comprises:

an arbor coaxially positioned within said container and slidably disposed along its longitudinal axis on the second line;

a plurality of vanes stored in a collapsed mode within said container each connected between said arbor and respective ones of said arms.

* * * * *